United States Patent [19]

Berg

[11] Patent Number: 4,936,171

[45] Date of Patent: Jun. 26, 1990

[54] ILLUMINATED SCREWDRIVER

[76] Inventor: Aaron R. Berg, 773 N. Verna Ave., Newbury Park, Calif. 91320

[21] Appl. No.: 301,156

[22] Filed: Jan. 23, 1989

[51] Int. Cl.[5] ..... B25B 23/08

[52] U.S. Cl. ..... 81/451; 362/120

[58] Field of Search ..... 362/119, 120; 81/451, 81/452

[56] References Cited

U.S. PATENT DOCUMENTS

| | | | |
|---|---|---|---|
| 1,769,510 | 7/1930 | Herman | 81/451 X |
| 2,408,601 | 10/1946 | Blauvelt | 362/120 |
| 2,706,769 | 4/1955 | Cook | 362/120 X |
| 2,773,974 | 12/1956 | Markett | 362/120 |
| 3,556,184 | 1/1971 | Wagner | 81/451 |
| 4,285,255 | 8/1981 | Winfrey | 81/451 |
| 4,768,137 | 8/1988 | Hwaw et al. | 362/120 |

*Primary Examiner*—D. S. Meislin

*Attorney, Agent, or Firm*—Allan M. Shapiro

[57] ABSTRACT

The base of the illuminated screwdriver attaches to the light source, and the screwdriver shank is attached to the base. The tip of the screwdriver is a flat metallic blade inserted into the shank. The shank is made of light transmissive material so that light from the source is delivered at the blade. A shield is slidably mounted on the shank to slide from a position away from the tip to a position surrounding the tip. The shield is made of insulator material to prevent the blade from shorting between adjacent screws.

17 Claims, 1 Drawing Sheet

ILLUMINATED SCREWDRIVER

FIELD OF THE INVENTION

This invention is directed to a screwdriver which is attachable to a light source so that light is delivered to the area immediately around the tip of the screwdriver.

BACKGROUND OF THE INVENTION

There are a number of situations where rotation of an adjustment screw is required, but the illumination in the area of the screw is low and it is undesirable to add a substantial amount of ambient illumination in order to find the adjustment screw. These situations arise in recording studios, television stations, radio stations, computer installations, in adjusting aerospace equipment and adjusting radio communications equipment. In other fields it is also helpful to have illumination at the screwdriver tip. This occurs in industries such as jewelry repair, television and video cassette recorder repair, and in various hobbies. There are a number of situations wherein the turning, adjusting or aligning of small screws is required, and illumination is helpful in finding those screws.

There are various small screwdrivers in the art, and most of these are suitable for making the necessary adjustments, but the direct illumination of the screw to be engaged by the screwdriver for its adjustment is also helpful.

SUMMARY OF THE INVENTION

In order to aid in the understanding of this invention, it can be stated in essentially summary form that it is directed to an illuminated screwdriver which has a shank which acts as a light pipe. The shank is attachable to a light source and carries a screwdriver blade on its tip end so that light is distributed at the tip end. An insulated sleeve may be provided so that it is movable from a position away from the tip end to a position surrounding the tip end. The sleeve serves as a screw finder and as an insulator to prevent shorting by the metallic blade.

It is thus a purpose and advantage of this invention to provide an illuminated screwdriver which makes it convenient to reach and adjust small screws in poorly illuminated areas.

It is another purpose and advantage of this invention to provide an illuminated screwdriver wherein the shank of the screwdriver is formed as a light pipe which is connected to a light source with the light pipe discharging the light to illuminate the blade at the tip of the screwdriver.

It is another object and advantage of this invention to provide an illuminated screwdriver which has a slidable insulator shield which is slidable on the shank of the screwdriver to serve both as a screw finder and as a shield to prevent the metallic screwdriver bit from shorting between adjacent screws.

The features of the present invention which are believed to be novel are set forth with particularity in the appended claims. The present invention, both as to its organization and manner of operation, together with further objects and advantages thereof, may be best understood by reference to the following description, taken in conjunction with the accompanying drawings.

DESCRIPTION OF THE PREFERRED EMBODIMENTS

Figures 1, 2, 3, 4, 5, 6, 7, 8:
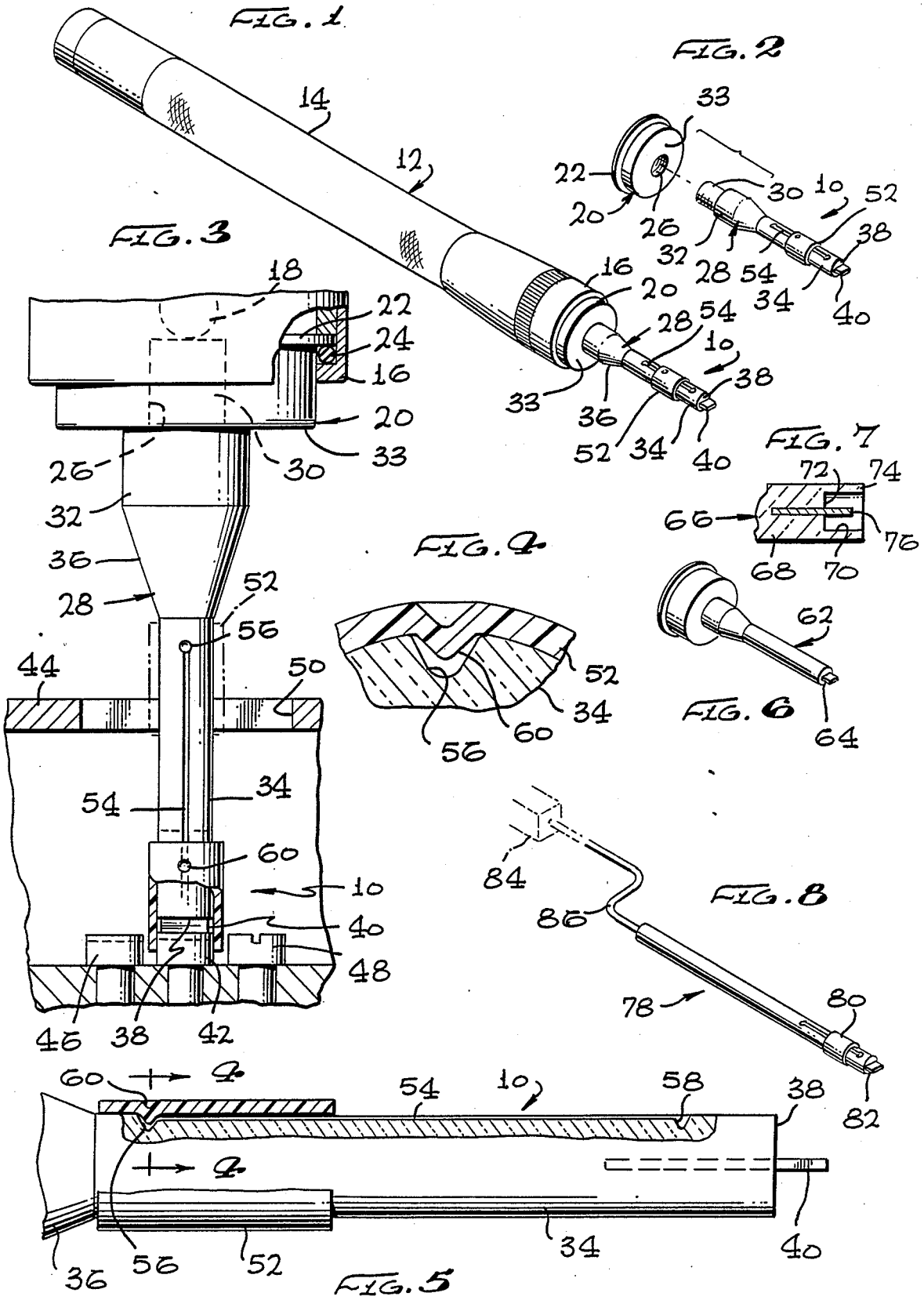
FIG. 1 is an isometric view of the illuminated screwdriver of this invention as mounted on a flashlight.
FIG. 2 is an exploded view of the illuminated screwdriver, independent of the flashlight.
FIG. 3 is an enlarged side-elevational view of the illuminated screwdriver as attached to a flashlight and shown in position to adjust a screw, with parts broken away and parts taken in section.
FIG. 4 is an enlarged section, with parts broken away, showing a detail of the sleeve and screwdriver shank, as seen generally along the line 4—4 of FIG. 5.
FIG. 5 is an enlarged side-elevational view of the shank of the illuminated screwdriver, with parts broken away and parts taken in section and showing the shield in the retracted position.
FIG. 6 is an isometric view of the second preferred embodiment of the illuminated screwdriver of this invention, showing it without a movable sleeve thereon.
FIG. 7 is a longitudinal section through the tip end of the shank of a third preferred embodiment of the screwdriver of this invention, showing a permanently installed shield thereon, with parts broken away.
FIG. 8 is an isometric view of a fourth preferred embodiment of the illuminated screwdriver of this invention, wherein the illuminated screwdriver is attached to a separate light source by virtue of a flexible light pipe.

The first preferred embodiment of the illuminated screwdriver of this invention is generally indicated at 10 in FIGS. 1, 2, 3 and 5. The screwdriver 10 is particularly arranged for securement on the front of a standard flashlight, which is indicated at 12 in FIG. 1. The flashlight 12 has a body 14 which is tubular and contains batteries therein. It may have a bottom cap for access to the battery. It has a front cap 16 which usually secures a lens in front of the bulb 18. The bulb is centrally located along the axis of the flashlight and is connected in series with the batteries through a switch which controls the current to the bulb.

The illuminated screwdriver 10 of this invention has a base 20 which is a circular body having a circular outstanding flange 22. The flange engages within the front cap, and an O-ring seal 24 between the cap and the base provides sealing integrity. The base has a central threaded hole 26 therein.

Shank 28 includes a threaded rod 30 which threads into hole 26. The shank has a flange 32 which is larger than the rod so as to serve as a stop for threading the rod 30 into the hole 26. When it is fully threaded in, with the flange 32 against the front face 33 of the base, the inner end of the rod 30, closest to bulb 18, is flush with the inner surface of the base. Furthermore, as seen in FIG. 3, the threaded rod and base are close to the bulb 18 so that the bulb 18 provides high intensity illumination to the base and threaded rod 30. Both the shank 28 and base 20 are made of a transparent material so as to transmit the light from the bulb. Injection molding is a preferred method of manufacture, and thus a thermoplastic synthetic polymer composition material is preferred. Suitable materials are acetate butyrate, polycarbonate or acrylic (methyl methacrylate). Other tough, transparent thermoplastic synthetic polymer composition materials are also suitable providing they are tough enough for the required service.

The main portion of shank 28 is the cylindrical body 34. The flange 32 joins the cylindrical body 34 in a cone 36 which has a small enough total included cone angle to provide total internal reflection of the light passing down the shank, so that a large amount is not lost coming out of the cone 36. Instead, the substantial portion of the light passing down through the shank passes out of the shank at tip 38.

The shank is slotted from the tip back a short distance to receive metal screwdriver blade 40. The blade is suitable for entry into the slots of small adjustment screws, such as adjustment screw 42 shown in FIG. 3. Control panel 44 is shown in FIG. 3. The control panel 44 has a large number of adjustable devices on the top surface thereof for adjusting various parameters. Those are the parameters which require regular adjustment, and thus they are positioned for convenience of use. However, there are other adjustments of some electronic equipment which need to be made occasionally or periodically, but should not be adjusted in the ordinary course of use of the equipment. Thus, those adjustments are put out of the way so that they are not inadvertently misadjusted by chance during everyday use. Such adjustments are made by adjusting screw 42 and its companion adjusting screws 46 and 48. In order to prevent inadvertent adjustment of those screws and the connected component, they are placed below the surface of control panel 44. Access is achieved thereto through slot 50 in the control panel. Of course, such placement of the adjusting screws makes it difficult to see them, and the illuminated screwdriver of this invention is particularly useful for finding and adjusting the screws. It is apparent from FIG. 3 that the adjusting screws are close together. If the metal blade 40 is improperly positioned, it may make an electrical short circuit between adjacent adjusting screws. This should be avoided.

Shield 52 is a right circular cylindrical tube which is a sliding fit on the cylindrical body portion 34 of the screwdriver shank. It is slidable from the full line position of FIG. 3 to the retracted dashed line position in FIG. 3. The retracted position is also shown in FIG. 5. Shield 52 is made of insulative material, and in its extended position shown in FIG. 3, it extends beyond the blade 40. In this position, the blade 40 is protected so that it cannot engage two of the adjusting screws at the same time. In addition to preventing short circuits, the shield 52 acts as a screw finder to help in engaging upon the adjusting screw.

In order to control and retain the shield 52 in its desired position along the length of the cylindrical body portion of the shank, groove 54 is formed longitudinally of the shank, in the outer surface thereof and parallel to the axis of the cylindrical body portion. Groove 54 terminates in recesses 56 and 58, which are generally conical recesses at the end of the groove. Shield 52 has a protrusion 60 on the interior cylindrical surface, as is seen in FIGS. 4 and 5. The protrusion may be molded in place or may be thermoplastically indented therein, as indicated by the dimples in the outer surface in FIG. 4. The inner protrusion is deeper than the groove 54 so that elastic deformation is necessary for the protrusion to pass through the groove. However, the protrusion 60 is not as large as the recesses 56 and 58 so that, when the protrusion reaches one or the other of those recesses, the elastic deformation is released, the protrusion extends into the recess and is resiliently retained there. In this way, the shield is detented in either its raised position, shown in dashed lines in FIG. 3, or its extended position, shown in full lines in FIG. 3. The engagement of the protrusion is sufficiently strong so that, in finding a screw while employing the shield as a screw finder, the shield is not thrust back to expose the metallic screwdriver blade 40.

When the bulb 18 is lighted, the entire back of the base 20 is lighted. Since the bulb 18 is closest to the threaded rod 30, the principal illumination goes down through the threaded rod, straight down the shank of the screwdriver, and leaves the shank at the tip 38. There is no substantial loss at cone 36. However, the lower face 33 of the base 20 also passes the light from the bulb into the general area in which the screwdriver is to be used. Thus, there are two principal sources of light which illuminate the area in which the screwdriver is to be used. The area is lighted by the light coming from face 33, and the local tip area is lighted by the light coming out of tip 38. The screwdriver is thus useful in reaching screws which are otherwise hard to see.

The screwdriver 62, shown in FIG. 6, is the same as the screwdriver 10 except that it has no shield. The cylindrical body of the screwdriver below its cone has no sliding shield thereon, but is a simple, straight cylindrical body. Screwdriver 62 has a blade 64 therein so that, when the screwdriver 62 is inserted into a flashlight such as flashlight 12, the screwdriver 62 illuminates the area of the blade. If desired, the screwdriver 62 may be molded in one piece of transparent thermoplastic synthetic polymer composition material, of the type described above, with the blade 64 subsequently inserted.

Screwdriver 66, shown in FIG. 7, is the third preferred embodiment of the illuminated screwdriver of this invention. The screwdriver shank includes a cylindrical body 68, which is the same as the cylindrical body 34. At the forward end of the body, recess 70 therein defines both a tip 72 and a permanent shield 74. Screwdriver blade 76 is within and protected by the shield. In this case, the shield is unitarily formed with the shank so that it is permanent.

The illuminated screwdriver 78, shown in FIG. 8, has the same cylindrical body portion of the shank as the screwdriver 10. The cylindrical body portion has a shield 80 slidable thereon to protect or leave open screwdriver blade 82. The structure is the same as that illustrated in FIG. 5. However, the shank is not illuminated by direct attachment to a flashlight, but by connection to a light source 84 by a flexible light pipe 86 such as a fiber optic bundle. By use of the screwdriver 78, shielding of the blade or not shielding the blade can be achieved by sliding the shield 80 from one detente position to another. The screwdriver shank in FIG. 8 is also of transparent light piping material so that the light is delivered at the tip of the shank at the blade for ease of locating the screw to be adjusted and positioning the screwdriver thereon for adjustment.

This invention has been described in its presently contemplated best modes, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. An illuminated screwdriver comprising:
a screwdriver body for manual grasp;
a screwdriver shank attached to said screwdriver body so that manual rotation of said screwdriver body causes rotation of said screwdriver shank, said screwdriver shank being made of optically transparent synthetic polymer composition material, said shank having a light input end and a tip end, a light-producing means in said body adjacent said light input end of said shank for illuminating said shank, at least a portion of said shank towards said tip end being of uniform cross section, a groove throughout a part of the length of said portion of said shank and a recess adjacent each end of said groove;
a metallic screwdriver blade attached to said tip end of said shank;
an insulative shield on said portion of said shank, said shield being slidably mounted on said portion from a position where it surrounds said blade to inhibit electrical contact with said blade to a position where it is retracted and is away from said blade, a protrusion inwardly extending in said sleeve and engaging in said groove so that said protrusion in said groove limits axial motion of said shield away from a forward position where it surrounds said blade to a retracted position where it is retracted from said blade, said recesses being at least as large as said protrusion to receive said protrusion in said shield when said shield is position in its shielding position and in its retracted position.

2. The illuminated screwdriver of claim 1,
wherein said portion of uniform cross section is circular and said shield is a circular tube surrounding said portion.

3. An illuminated screwdriver comprising:
a screwdriver shank made of optically transparent synthetic polymer composition material, said shank having a light input end and a tip end;
a metallic screwdriver blade attached to said tip end of said shank so that when light is supplied into said light input of said shank, light is delivered from said tip end of said shank to illuminate adjacent said blade;
means on said light input end for attachment to a light source, at least a portion of said shank toward said tip end being of uniform cross section, a groove throughout a part of the length of said portion of said shank and a recess adjacent each end of said groove;
an insulative shield on said shank, said shield being slidably mounted on said portion of said shank from a position where it surrounds said blade to a position where it is retracted and is away from said blade, a protrusion extending inwardly within said sleeve and engaging in said groove so that said protrusion in said groove limits axial motion of said shield from a forward position where it surrounds said blade to a retracted position where it is retracted from said blade, said recesses being at least as large as said protrusion to receive said protrusion in said shield when said shield is positioned in its shielding position wherein said shield surrounds said blade to inhibit electrical contact with said blade and in its retracted position.

4. The illuminated screwdriver of claim 3
wherein said shield is made of clear synthetic polymer composition material.

5. The illuminated screwdriver of claim 3
wherein there is a base attached to said shank at said light input end of said shank, said base having a flange thereon for engagement under the cap of a flashlight so that said base is attached to the flashlight adjacent its bulb so that the bulb delivers illumination to said base and to said light input of said shank.

6. An illuminated screwdriver comprising:
a screwdriver shank made of optically transparent synthetic polymer composition material, said shank having a light input end of said shank;
a metallic screwdriver blade attached to said tip end of said shank;
a base attached to said shank at said light input end of said shank, said base having a flange thereon for engagement under a cap of a flashlight, said base being circular and said flange being circular and a central opening in said base, said shank having a rod extending within said central opening of said base to attach said shank to said base so that when light is supplied into said light input end of said shank, light is delivered from said tip end of said shank to illuminate adjacent said blade.

7. The illuminated screwdriver of claim 6
wherein said rod is threaded and said opening in said base is threaded so that said shank is screwed into said base.

8. The illuminated screwdriver of claim 6
wherein said base has a face thereon and said shank has a flange thereon engaging a portion of said face to position said shank with respect to said base, said base being made of transparent material so that light is emitted from the face thereof surrounding said flange on said shank.

9. The illuminated screwdriver of claim 8
wherein said flange on said shank joins said shank with a cone and said cone angle is below the Brewster angle so that light entering said shank is reflected in said cone and passes to said tip of said shank.

10. The illuminated screwdriver of claim 8
wherein said shank has an insulative shield thereon surrounding said blade to inhibit electrical contact with said blade.

11. The illuminated screwdriver of claim 10
wherein said shield extends beyond said blade.

12. The illuminated screwdriver of claim 10
wherein said shield is integrally formed with said shank.

13. The illuminated screwdriver of claim 10
wherein at least a portion of said shank towards said tip end is of uniform cross section and said shield is slidably mounted on said portion from a position where it surrounds said blade to a position where it is retracted and is away from said blade.

14. The illuminated screwdriver of claim 13
wherein said portion of said tip of uniform cross section is circular and said shield is a circular tube surrounding said portion.

15. The illuminated screwdriver of claim 13
wherein there is a groove throughout a part of the length of said portion of said shank and there is a protrusion inwardly extending in said sleeve and engaging in said groove so that said protrusion in said groove limits axial motion of said shield from a forward position wherein it surrounds said blade to a retracted position where it is retracted from said blade.

16. The illuminated screwdriver of claim 15 wherein there is a recess adjacent each end of said groove, said recess being at least as large as said protrusion to receive said protrusion in said shield when said shield is positioned in its shielding position and in its retracted position.

17. The illuminated screwdriver of claim 16 wherein said shield is made of clear synthetic polymer composition material.

* * * * *